United States Patent [19]

Poroshin et al.

[11] Patent Number: 4,850,861

[45] Date of Patent: Jul. 25, 1989

[54] APPARATUS FOR CONDUCTIVE DRYING LOOSE

[76] Inventors: Jury E. Poroshin, ulitsa Volodarskogo, 32, kv. 68.; Igor M. Gorbachev, ulitsa Kirova, 2I, kv.20I.; Vladimir M. Potysiev, ulitsa Svobodyv, 66, kv.87., all of Chelyabinsk; Vladimir P. Sorochkin, ulitsa Lenina, 3a, kv.24., Mtsensk Orlovskoi oblasti; Vladimir I. Sivko, Novy gorod, Moskovsky prospekt, I75, kv.672, Brezhnev, all of U.S.S.R.

[21] Appl. No.: 235,681

[22] PCT Filed: Sep. 16, 1986

[86] PCT No.: PCT/SU86/00086

§ 371 Date: May 11, 1988

§ 102(e) Date: May 11, 1988

[87] PCT Pub. No.: WO88/02090

PCT Pub. Date: Mar. 24, 1988

[51] Int. Cl.[4] ..... F27B 15/10

[52] U.S. Cl. ..... 432/99; 432/102; 432/114; 432/112

[58] Field of Search ..... 432/105, 107, 109, 112, 432/114, 96, 98, 99, 100–102

[56] References Cited

U.S. PATENT DOCUMENTS

| | | | |
|---|---|---|---|
| 685,336 | 10/1901 | Leroy et al. | 432/102 |
| 4,007,014 | 2/1977 | Matsumoto et al. | 432/95 |
| 4,008,994 | 2/1977 | Numasaki et al. | 432/102 |
| 4,120,644 | 10/1978 | Numasaki et al. | 432/102 |
| 4,254,221 | 3/1981 | Beckenbach | 432/98 |
| 4,376,343 | 3/1983 | White et al. | 432/112 |
| 4,427,376 | 1/1984 | Etnyre et al. | 432/114 |
| 4,462,870 | 7/1984 | Wilson et al. | 432/102 |

FOREIGN PATENT DOCUMENTS

| | | |
|---|---|---|
| 2060027 | 6/1974 | Fed. Rep. of Germany . |
| 2354523 | 1/1978 | France . |
| 264980 | 7/1970 | U.S.S.R. . |
| 918752 | 4/1982 | U.S.S.R. . |
| 983250 | 12/1982 | U.S.S.R. . |
| 1177623 | 9/1985 | U.S.S.R. . |
| 1216600 | 3/1986 | U.S.S.R. . |

*Primary Examiner*—Henry C. Yuen

*Attorney, Agent, or Firm*—Lilling & Greenspan

[57] ABSTRACT

The apparatus includes a housing 1 accommodating inner and outer tubes 2 and 4, respectively, arranged concentrically relative to each other. Lower ends of the tubes 2 and 4 are connected by a flange 15 to a disk-type feeder 14 the flange and feeder having holes 13 and 21 through which the interior of a heating chamber 9 confined between the outer wall of the outer tube 4 and inner wall of the housing 1 communicates with interior 17 of the inner tube 2 and with the interior of the drying chamber 6 confined between the outer wall of the inner tube 2 and inner wall of the outer tube 4. Communicating with the drying chamber 6 are a charging hopper 7 and a discharging means 8 occupying the bottom part of the apparatus. Disposed in the wall of the housing 1 between the flange 15 and worm 5 of the outer tube 4 is a furnace 11 having a burner 12 and communicating with the interior of the heating chamber 9. In addition, the heating chamber 9 communicates with an exhaust pipe 10 of a suction means.

2 Claims, 1 Drawing Sheet

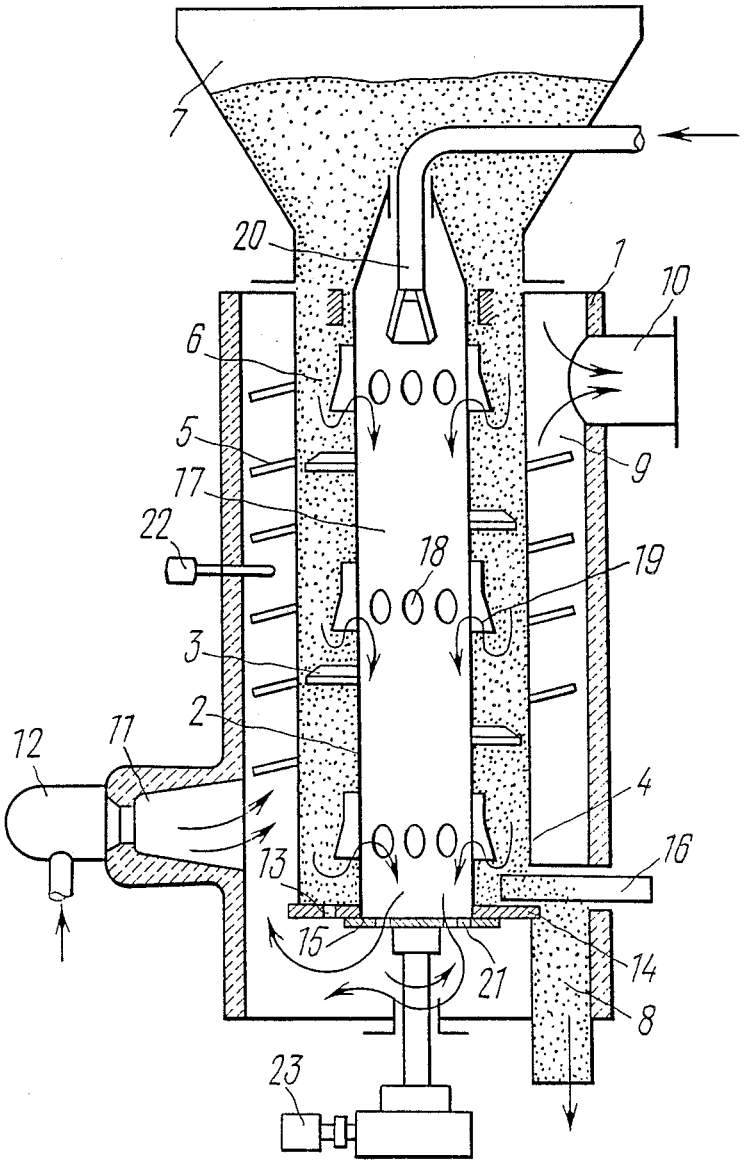
7
20
1
10
6
5
9
17
22
18
19
3
2
12
11
4
16
13
15
14
21
8
23

APPARATUS FOR CONDUCTIVE DRYING LOOSE

BACKGROUND OF THE INVENTION

1. Field of the Invention

This invention relates to processes associated with drying loose materials, and more particularly to apparatus for conductive drying loose materials.

2. Description of the Prior Art

There is known an apparatus (cf., USSR Inventor's Certificate No. 918,752, Int. Cl. F 26 B 17/26, published 1982) for drying loose materials including metal chips containing combustibles. The apparatus comprises a drying chamber over which there is disposed a furnace separated from the drying chamber by a perforated partition wall, a heat exchanger for heating balls of a headpiece, a magnetic drum for separating the headpiece balls from chip when the headpiece is heated to the Curie point (for iron-carbon alloys the Curie point is +768° C.), an oscillating conveyer of the drying chamber, and an elevator for returning the balls of the headpiece for reuse.

The material is heated and dried in the drying chamber upon contact with the heated balls.

Oil evaporating from the material is subjected to reburning, the oil vapour entering through the perforated partition from the drying chamber to the furnace thereby providing extra heat utilized for heating the headpiece balls in the heat exchanger.

One disadvantage of this prior art apparatus is that it cannot be used oro drying fusible alloys having a melting point below the Curie point, heating to this point being necessary for separating the balls of the headpiece from the magnetic drum.

The provision of the elevator for returning the balls of the headpiece, the magnetic drum, and oscillating conveyer in the drying chamber requires consumption of an excessive amount of energy for the drying process.

The apparatus is not capable of high thermal efficiency, since for removing moisture and oil it is necessary to heat the material to a temperature of 200° C. to 350° C., whereas the headpiece must be heated to 768° C. to be separated from the magnetic drum.

Waste gases escaping from the apparatus have the same high temperature thus making the consumption of heat energy substantial. In addition, in the course of conveying, the balls of the headpiece tend to lose heat transferring it to the elevator and oscillating conveyer.

There also is known a drum-type undirect heating apparatus for drying loose materials (cf., West German Pat. No. 2,060,027, Cl. 82*a* 19/01, published 1973). The apparatus comprises a housing accommodating inner and outer tubes arranged concentrically relative to each other. Flue or waste gas is withdrawn through the inner tube in a direction counter to the travel path of the material in the drying chamber confined between the walls of the inner and outer tubes, rigidly interconnected and capable of being rotated by an external drive. The interior of the heating chamber is defined by a space between the walls of the housing and outer tube. Connected to the housing is a furnace communicating with the heating chamber. A flare of the outer tube of the drying chamber extends to a discharge means and is connected to a device for suctioning the vapours of moisture and oil. The drying chamber is isolated from the heating chamber by sealing members. The heating chamber communicates with the interior of the inner tube through a flue chamber in turn communicable with the discharge means. The inner tube of the drying chamber is connected with a worm, which is in contact with the walls of the outer tube connected to a second worm.

Inherent in this prior art apparatus is a disadvantage in that oil evaporated from the material being dried is not utilized by secondary burning, and therefore the potential heat from such oil vapours is not used as an additional source of energy, which makes this apparatus less energy efficient.

Another disadvantage resides in that the heating process is carried out without evacuation of the evaporated oil and moisture to result in oxidation and carbonization of the material.

In addition, the horizontal arrangement of the drum of the drying chamber determines the large size of the apparatus.

SUMMARY OF THE INVENTION

The present invention is therefore directed toward the provision of an apparatus for conductive heating loose materials, in which a chamber for drying the material and a heating chamber would be so constructed as to improve the quality of drying and make the apparatus more fuel-efficient by utilizing combustion heat of the evaporate oil.

The aims of the invention are attained by an apparatus for conductive drying loose materials comprising a housing accommodating outer and inner tubes arranged concentrically relative to each other, connected therebetween, and provided with worms at their outer walls, charging and discharging means communicating with the interior of a drying chamber confined between the outer wall of the inner tube and inner wall of the outer tube, a pipe of a suckoff means, and a furnace with a burner communicating with the interior of a heating chamber confined between the outer wall of the outer tube and inner wall of the housing. According to the invention, in the vertical arrangement of the apparatus the inner tube is capable of rotation, whereby the lower ends of the inner and outer tubes are connected by means of a flange to a disk-type feeder provided with holes, the interior of the drying chamber communicating with the interior of the heating chamber by way of the holes in the disk-type feeder, whereas the interior of the inner tube communicates with the interior of the drying chamber through the holes in the flange, the furnace being positioned between the flange and worm of the outer tube, the discharging means occupying the bottom part of the apparatus.

In order to prevent extensive contact of the material being dried with vapours of moisture and oil causing oxidation and carbonization, the inner tube is preferably provided with openings and has a burner mounted in the upper part thereof.

The invention ensures higher quality of drying and requires less fuel to be consumed for the drying process.

BRIEF DESCRIPTION OF THE DRAWINGS

The invention will now be described in greater detail with reference to a specific embodiment thereof taken in conjunction with the sole FIGURE of the accompanying drawings illustrating an apparatus for conductive drying loose materials.

DESCRIPTION OF THE PREFERRED EMBODIMENT

The proposed apparatus comprises a housing 1 accommodating an inner tube 2 with a worm 3 and an outer tube 4 with a worm 5, these tubes 2 and 4 being arranged concentrically relative to each other and communicating therebetween. The interior of a drying chamber 6 confined between the outer wall of the inner tube 2 and inner wall of the outer tube 4 communicates with charging and discharging means 7 and 8, respectively. The interior of a heating chamber 9 confined between the outer wall of the outer tube 4 and inner wall of the housing 1 communicates with an exhaust pipe 10 of a suction means. A furnace 11 has a burner 12, and is secured in the wall of the housing 1. The interior of the drying chamber 6 communicates with the interior of the heating chamber 9 by way of holes 13 provided in a disk-type feeder 14 of a flange 15 connecting the lower ends of the inner and outer tubes 2 and 4. The discharging means 8 has an adjustable plunger 16.

Interior 17 of the inner tube 2 communicates with the drying chamber 6 by way of openings 18 provided in the tube 2. Each such opening 18 has a shield 19. A burner 20 is further provided in the upper part of the interior 17 of the tube 2.

The flange 15 has holes 21 to communicate the interior 17 of the tube 2 with the heating chamber 9, which accommodates a thermometer 22.

The inner tube 2 and disk feeder 14 are connected to a rotation drive 23.

The herein proposed apparatus for feeding loose materials operates in the following manner.

Moist loose material is placed in the charging means or hopper 7 to be admitted to the chamber 6, and the rotation drive 23 is energized to rotate the inner tube 2 with the worm 3 and disk feeder 14. Then the suction means for evacuating gases through the pipe 10, and burners 12 and 20 are actuated in succession. An underpressure or vacuum is produced by the suction means in the heating chamber 9 and in the interior 17 of the tube 2 communicating therewith through the holes 21.

Fuel combustion products generated by the burner 20 move from this burner 20 along the interior 17 of the tube 2, pass through the holes 21, and enter the heating chamber 9, where they are mixed with combustion products produced by the burner 12, after which the thus mixed combustion products move upwards along the helical guide of the worm 5 toward the pipe 10.

The downward travel of the fuel combustion products from the burner 20 acts to vigorously heat the surface of the inner tube 2 and worm 3 for the heat to be transferred therefrom to the loose material moving downwards by the worm 3.

In the course of the upward travel of the combustion products the helical guide of the worm 9 and outer tube 4 tend to be vigorously heated. The heat is transferred therefrom to the material being heated. During its movement in the drying chamber 6 the material is heated on two sides, whereby moisture and oil present in the material are evaporated, and the vapours are evacuated through the openings 18 in the course of the drying process. The oil vapours tend to partially burn in the flame of the burner 20. The remaining part of the oil vapours moves from the interior 17 through the holes 21 in the flange 15 to the heating chamber 9 to be burned in the flame of the burner 12. The flame of this burner 12 also burns the oil vapours entering from the drying chamber 6 through the holes 13.

According to one feature of the herein proposed invention, the apparatus is so constructed as to ensure complete burning of the oil vapours, whereas the heat thereby released is used for additionally heating the loose material being dried.

In the course of heating the material does not contact with the fuel combustion products, whereby oxidation of the material is obviated.

Rotation of the worm 3 promotes uniform heating and drying of the material.

The capacity of the proposed apparatus is controlled by the rotational speed of the disk feeder 14, depending on the initial condition of the material being dried.

The apparatus can operate in an automatic mode, by maintaining a continuous drying temperature through varying the flow rate of gas fed to the burners 12 and 20 in response to the readings of the thermometer 22.

The amount of underpressure or vacuum in the pipe 10 is controlled so that evacuation of oil and moisture vapours through the holes 13, 18 and 21 is carried out simultaneously with suction of air through the discharging means 8. This enables to maintain burning of gas and oil vapours in the heating chamber 9, and cool the material as it is discharged from the apparatus.

The loose material is heated in a counterflow of waste gases without direct contact of the material therewith. This results in a substantial reduction in the temperature of the waste gases escaping from the apparatus, and therefore improves thermal efficiency of the apparatus.

Because the loose material being dried is not in extensive contact with water and oil vapours due to their continuous evacuation from the material at the locations where they are formed through the openings 18 to the interior 17 of the inner tube 2, the proposed apparatus ensures a higher quality of drying. The absence of extensive contact between the material being dried and water vapours results in less pronounced oxidation of the material, whereas the absence of extensive contact with oil vapours reduces carbonization.

Continuously maintained temperature conditions by automatically varying the feed of gas to the burners 12 and 20 in response to the readings of the thermometer 22 prevents overheating or underheating of the material, otherwise resulting, accordingly, either in oxidation of the material or excessive content of moisture and oil therein.

The proposed apparatus is more fuel-efficient due to utilization of the heat produced by oil vapour burning, which affords a reduction in the amount of fuel gas consumed for the drying process.

The invention can fine application in metallurgy and other fields of the industry for drying pulverulent materials, such as chips of cast iron, non-ferrous metals and alloys thereof.

We claim:

1. An apparatus for conductive drying loose materials comprising a housing (1) accommodating outer and inner tubes (2 and 4) arranged concentrically relative to each other, connected therebetween, and provided with worms (3 and 5) at their outer walls, charging and discharging means (7 and 8) communicating with the interior of a drying chamber (6) confined between the outer wall of the inner tube (2) and inner wall of the cuter tube (4), a pipe (10) of a suction means, and a furnace (11) with a burner (12) communicating with the interior of a heating chamber (9) confined between the outer wall of the outer tube (4) and inner wall of the housing (1), characterized in that in the vertical arrangement of the apparatus the inner tube (2) is capable of rotation, whereas lower ends of the inner and outer tubes (2 and 4) are connected by means of a flange (15) to a disk-type feeder (14) provided with holes (13,21), the interior of the drying chamber (6) communicating with the interior of the heating chamber (9) by way of the holes (13) in the disk-type feeder (14), whereas an interior (17) of the inner tube (2) communicates with the interior of the drying chamber(9) through the holes (21) in the flange (15), the furnace (11) being positioned between the flange (15) and worm (5) of the outer tube (4), the discharging means (8) occupying the bottom part of the apparatus.

2. An apparatus for conductive drying loose materials as claimed in claim 1, characterized in that the inner tube (2) has openings (18), and is provided with a burner (20) mounted in the upper part of the inner tube (2).

* * * * *